US008635989B2

(12) United States Patent
Anetsberger et al.

(10) Patent No.: US 8,635,989 B2
(45) Date of Patent: Jan. 28, 2014

(54) METHOD AND DEVICE FOR OPERATING AN INJECTION SYSTEM FOR AN INTERNAL COMBUSTION ENGINE

(75) Inventors: Daniel Anetsberger, Teugn (DE); Christoph Klesse, Wörth A.D. Donau (DE); Thomas Riedel, Regensburg (DE); Wolfgang Stapf, Karlskron (DE); Björn von Willmann, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 313 days.

(21) Appl. No.: 13/127,547

(22) PCT Filed: Oct. 19, 2009

(86) PCT No.: PCT/EP2009/063658

§ 371 (c)(1),
(2), (4) Date: May 4, 2011

(87) PCT Pub. No.: WO2010/052119

PCT Pub. Date: May 14, 2010

(65) Prior Publication Data

US 2011/0213546 A1 Sep. 1, 2011

(30) Foreign Application Priority Data

Nov. 4, 2008 (DE) ..... 10 2008 055 747

(51) Int. Cl.
*F02M 37/04* (2006.01)

(52) U.S. Cl.
USPC ..... 123/447; 123/457; 123/511

(58) Field of Classification Search
USPC ..... 701/103; 123/436, 447, 456, 457, 492, 123/510, 511
See application file for complete search history.

(56) References Cited

U.S. PATENT DOCUMENTS 6,871,633 B1 * 3/2005 Date et al. ..... 123/447
7,438,051 B2 * 10/2008 Wachtendorf et al. ..... 123/446

(Continued)

FOREIGN PATENT DOCUMENTS

DE 102004032178 A1 1/2006 ..... F02M 63/00
DE 102004062613 A1 7/2006 ..... F02D 41/38

(Continued)

OTHER PUBLICATIONS

German Office Action, German Patent Application No. 10 2008 055 747.1-13, 2 pages, Oct. 21, 2009.

(Continued)

*Primary Examiner* — Hai Huynh
(74) *Attorney, Agent, or Firm* — King & Spalding L.L.P.

(57) ABSTRACT

A method for operating an injection system has the following steps: determining, based on a pilot control characteristic, a prefeed value depending on an internal combustion engine operating parameter; initializing a correction value for the prefeed pump by a safety value predetermined for compensating deviations from a predetermined delivery behavior of the prefeed pump, which deviations lie within a predetermined tolerance range, for guaranteeing a sufficient pump delivery rate; controlling the prefeed pump depending on the prefeed and the correction values; adapting the correction value effecting the delivery behavior of the prefeed pump depending on a variable of the system the value or value curve of which indicates that a desired pressure can be generated in the fuel accumulator, namely in the sense of reducing the delivery output of the prefeed pump, as long as the value indicates that the desired pressure can be generated in the fuel accumulator.

17 Claims, 3 Drawing Sheets

(56) References Cited

U.S. PATENT DOCUMENTS

| | | | | |
|---|---|---|---|---|
| 8,210,155 | B2 * | 7/2012 | Ohta et al. | 123/446 |
| 2004/0007214 | A1 | 1/2004 | Schmidl et al. | 123/514 |
| 2007/0295310 | A1 | 12/2007 | Achleitner et al. | 123/495 |
| 2008/0072880 | A1 | 3/2008 | Wachtendorf et al. | 123/495 |

FOREIGN PATENT DOCUMENTS

| | | | | |
|---|---|---|---|---|
| DE | 10207062215 | A1 | 6/2009 | F02D 41/30 |
| EP | 1296060 | A2 | 8/2002 | F04B 49/22 |
| WO | 2006/032577 | A1 | 3/2006 | F02D 41/38 |

OTHER PUBLICATIONS

International PCT Search Report and Written Opinion, PCT/EP2009/063658, 16 pages, Feb. 16, 2010.

* cited by examiner

METHOD AND DEVICE FOR OPERATING AN INJECTION SYSTEM FOR AN INTERNAL COMBUSTION ENGINE

CROSS-REFERENCE TO RELATED APPLICATIONS

This application is a U.S. National Stage Application of International Application No. PCT/EP2009/063658 filed Oct. 19, 2009, which designates the United States of America, and claims priority to German Application No. 10 2008 055 747.1 filed Nov. 4, 2008, the contents of which are hereby incorporated by reference in their entirety.

TECHNICAL FIELD

The invention relates to a method and a device for operating an injection system for an internal combustion engine.

BACKGROUND

Injection systems are used to inject fuel into combustion chambers of an internal combustion engine, in particular a diesel internal combustion engine, which injection systems have been increasingly configured in the last years as what are known as "common rail" systems. In the latter, the injectors which are arranged in the combustion chambers are supplied with fuel from a common fuel accumulator, the common rail. Here, the fuel which is to be injected is present in the fuel accumulator at a pressure of up to over 2000 bar.

Injection systems for internal combustion engines usually have various pumps, by means of which fuel is conveyed, in order to be introduced into combustion chambers of the internal combustion engine. Injection systems of this type for internal combustion engines make high requirements of the accuracy of the injection pressure which is required for the injection of the fuel into the combustion chambers of the internal combustion engine.

This is particularly important, since more and more stringent legal regulations are being passed with regard to the permissible pollutant emissions of internal combustion engines which are arranged in motor vehicles. Said legal regulations make it necessary to take various measures, by which the pollutant emissions are reduced. Thus, for example, the formation of soot is greatly dependent on the preparation of the air/fuel mixture in the respective cylinder of the internal combustion engine. Here, it is advantageous for the reduction in the pollutant emissions if the fuel can be injected very precisely into the cylinder.

EP 1 296 060 B1 has disclosed an injection system for an internal combustion engine, having a prefeed pump, by way of which fuel can be conveyed out of a fuel tank to the suction side of a high pressure pump. A high pressure pump which is connected hydraulically behind the prefeed pump then conveys fuel into a fuel accumulator, from where it can then be distributed to injectors which are coupled hydraulically to the fuel accumulator. In the case of a suitable actuation of the high pressure pump, a predefined pressure which is dependent on the operating parameters of the internal combustion engine can be reached in the fuel accumulator.

SUMMARY

According to various embodiments, a method and a device for operating an injection system for an internal combustion engine can be provided, by way of which precise and reliable metering of fuel for the internal combustion engine and a simple construction of the injection system are made possible in a simple way.

According to an embodiment, a method for operating an injection system for an internal combustion engine having a prefeed pump for conveying fuel out of a fuel tank and having a high pressure pump which is arranged downstream of the prefeed pump for conveying the fuel into a fuel accumulator, mau=y comprise the following steps:—determining a prefeed value which is a function of at least one operating variable of the internal combustion engine as a function of a pilot control characteristic diagram,—initializing a correction value for the prefeed pump with a safety value which is predefined in such a way that deviations from a predefined conveying behavior of the prefeed pump which lie within a predefined tolerance range are compensated for in such a way that a sufficient delivery performance of the prefeed pump is ensured,—actuating the prefeed pump as a function of the prefeed value and the correction value, and—adapting the correction value with regard to its effect to the conveying behavior of the prefeed pump as a function of a variable of the injection system, the value or value profile of which variable is representative for whether a desired pressure can be reached in the fuel accumulator, to be precise in the context of a reduction in the delivery performance of the prefeed pump as long as the value is representative for the fact that the desired pressure is reached in the fuel accumulator.

According to a further embodiment, the variable of the injection system, the value or value profile of which variable is representative for whether a desired pressure can be reached in the fuel accumulator, can be a determined time-dependent profile of the pressure in the fuel accumulator, and the value being representative in this period for the fact that predefined deviations are not exceeded by a setpoint value of the pressure. According to a further embodiment, the injection system may have a volumetric flow control valve which is arranged hydraulically between the prefeed pump and the high pressure pump and by way of which the fuel flow from the prefeed pump into the high pressure pump can be set, the variable of the injection system, the value or value profile of which variable is representative for whether a desired pressure can be reached in the fuel accumulator, being a time-dependent profile of a value of an actuating variable of the volumetric flow control valve, which value is representative for the requirement of fuel for the high pressure pump, and the value being representative in this period for the fact that a predefined value range of the actuating variable of the volumetric flow control valve is not departed from. According to a further embodiment, the correction value can be adapted with regard to its effect to the conveying behavior of the prefeed pump during an idling mode of the internal combustion engine. According to a further embodiment, the correction value can be adapted with regard to its effect to the conveying behavior of the prefeed pump during a full load mode of the internal combustion engine.

According to another embodiment, a device for operating an injection system for an internal combustion engine having a prefeed pump for conveying fuel out of a fuel tank and having a high pressure pump which is arranged downstream of the prefeed pump for conveying the fuel into a fuel accumulator, can be configured to:—determine, as a function of a pilot control characteristic diagram, a prefeed value which is a function of at least one operating variable of the internal combustion engine,—initialize a correction value for the prefeed pump with a safety value which is predefined in such a way that deviations from a predefined conveying behavior of the prefeed pump which lie within a predefined tolerance range are compensated for in such a way that a sufficient delivery performance of the prefeed pump is ensured,—actuate the prefeed pump as a function of the prefeed value and the correction value, and—to adapt at the correction value with regard to its effect to the conveying behavior of the prefeed pump as a function of a variable of the injection system, the value or value profile of which variable is representative for whether a desired pressure can be achieved in the fuel accumulator, to be precise in the context of a reduction in the delivery performance of the prefeed pump as long as the value is representative for the fact that the desired pressure can be reached in the fuel accumulator.

BRIEF DESCRIPTION OF THE DRAWINGS

Exemplary embodiments are explained in greater detail in the following text using diagrammatic drawings, in which.

DETAILED DESCRIPTION

Figure 1:
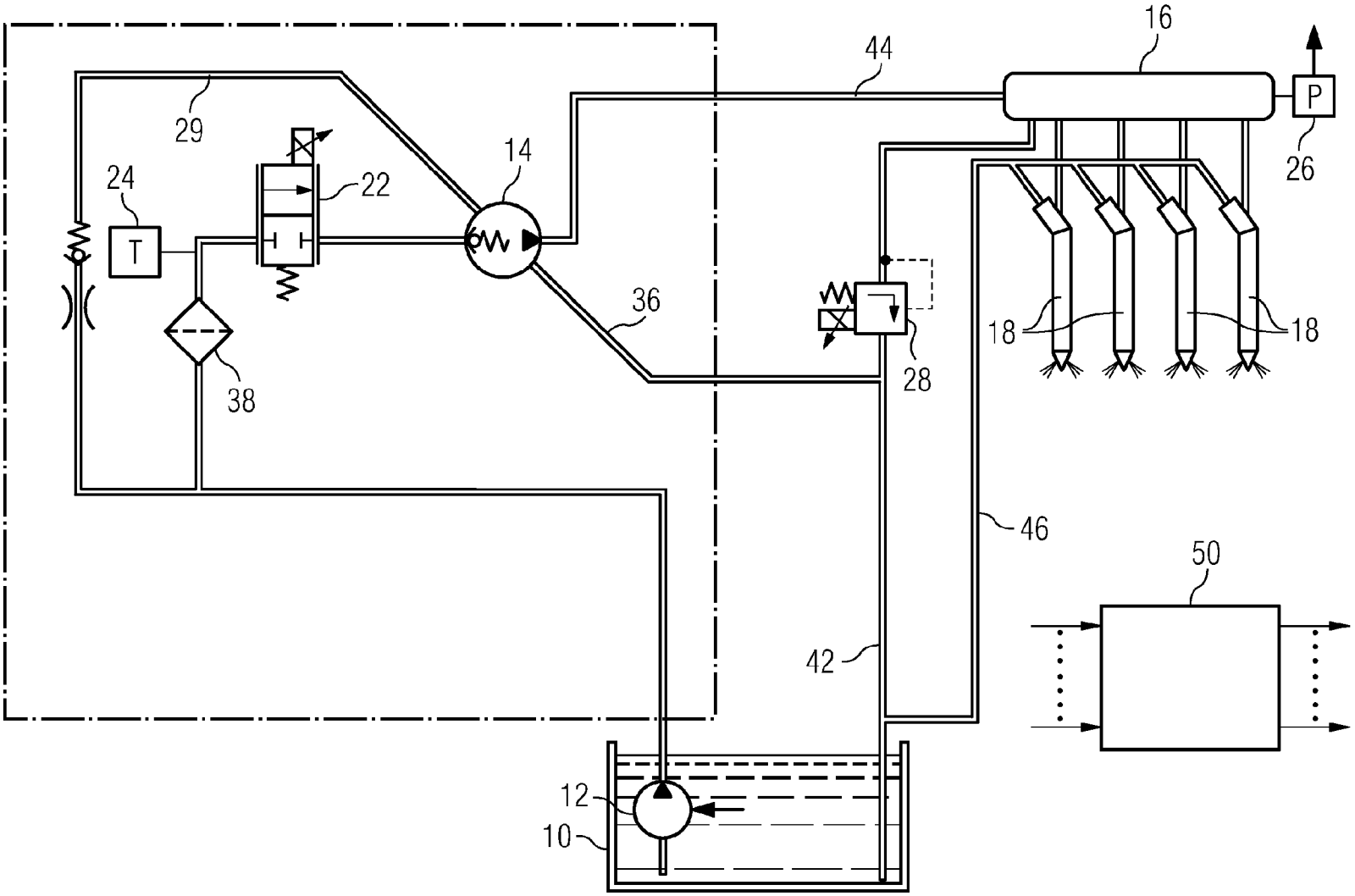
FIG. 1 shows a block circuit diagram of an injection system for an internal combustion engine having a control unit.

According to various embodiments, in a method and a corresponding device for operating an injection system for an internal combustion engine a prefeed pump for conveying fuel out of a fuel tank can be provided and a high pressure pump can be arranged downstream of the prefeed pump for conveying the fuel into a fuel accumulator. The method comprises the following steps: a prefeed value which is a function of at least one operating variable of the internal combustion engine is determined as a function of a pilot control characteristic diagram. A correction value for the prefeed pump is initialized with a safety value which is predefined in such a way that deviations from a predefined conveying behavior of the prefeed pump which lie within a predefined tolerance range are compensated for in such a way that a sufficient delivery performance of the prefeed pump is ensured. The prefeed pump is actuated as a function of the prefeed value and the correction value, and the correction value is adapted with regard to its effect to the conveying behavior of the prefeed pump as a function of a variable of the injection system, the value or value profile of which variable is representative for whether a desired pressure can be reached in the fuel accumulator, to be precise in the context of a reduction in the delivery performance of the prefeed pump as long as the value is representative for the fact that the desired pressure is reached in the fuel accumulator.

To this extent, the correction value is changed with reduction of the delivery performance of the prefeed pump until the variable of the injection system, the value or value profile of which variable is representative for the fact that a desired pressure can be reached in the fuel accumulator, exhibits a behavior which indicates that the fuel is just available in the fuel accumulator in a sufficient quantity and at a sufficient pressure for injection into the internal combustion engine.

This has the advantage that the prefeed pump can be adapted in a simple way with regard to its conveying behavior to the requirements of the injection system. Since the correction value is adapted just so much as is still required for reliable operation of the injection system, the prefeed pump can be operated in an energetically favorable conveying range, without it being necessary for fuel to be additionally conveyed by the prefeed pump in an unnecessary way.

According to one embodiment, the variable of the injection system, the value or value profile of which variable is representative for whether a desired pressure can be reached in the fuel accumulator, is a determined time-dependent profile of the pressure in the fuel accumulator, and the value is representative in this period for the fact that predefined deviations are not exceeded by a setpoint value of the pressure. This is advantageous, since further sensors for controlling and/or regulating the prefeed pump can be dispensed with as a result of the use of a pressure sensor which is required anyway in the injection system.

According to a further embodiment, the injection system has a volumetric flow control valve which is arranged hydraulically between the prefeed pump and the high pressure pump and by way of which the fuel flow from the prefeed pump into the high pressure pump can be set. The variable of the injection system, the value or value profile of which variable is representative for whether a desired pressure can be reached in the fuel accumulator, is a time-dependent profile of a value of an actuating variable of the volumetric flow control valve, which value is representative for the requirement of fuel for the high pressure pump, and the value is representative in this period for the fact that a predefined value range of the actuating variable of the volumetric flow control valve is not departed from. This is advantageous, since further sensors for controlling and/or regulating the prefeed pump can be dispensed with as a result of the use of an actuating signal for the volumetric flow control valve which is required anyway in the injection system. According to a further embodiment, the correction value is adapted with regard to its effect to the conveying behavior of the prefeed pump during an idling mode of the internal combustion engine. This has the advantage that there are steady state operating conditions of the internal combustion engine during the idling mode, and the correction value can thus be adapted particularly simply and accurately.

According to a further embodiment, the correction value is adapted with regard to its effect to the conveying behavior of the prefeed pump during a full load mode of the internal combustion engine. This has the advantage that, in the full load mode, the profile of the value of the measured variable or of the value of the actuating variable of the injection system which is representative of the quantity of the delivery of fuel into the fuel accumulator reacts particularly sensitively to changes in the correction value, and the correction value can thus be adapted particularly accurately.

The injection system (shown in FIG. 1) for an internal combustion engine has a fuel tank 10, out of which fuel is conveyed by means of a prefeed pump 12. The prefeed pump 12 is preferably configured as a vane cell pump. However, another pump type can also be used for the prefeed, for example a gearwheel pump or a gerotor pump. An electrically operated prefeed pump 12 can be used, as a result of which it is possible to control the delivery performance of the prefeed pump 12 independently of the delivery performance of further pumps. In one embodiment which is shown here, the prefeed pump 12 is what is known as an in-tank pump; that is to say, it is arranged inside the fuel tank 10 and is preferably configured as an immersion pump.

A high pressure pump 14 for conveying the fuel into a fuel accumulator 16 is arranged downstream of the prefeed pump. The fuel accumulator 16 is hydraulically coupled to the high pressure pump 14 via a fuel accumulator feed line 44. The high pressure pump 14 can preferably be configured as a radial piston pump or as an in-line piston pump having a plurality of cylinder units, as are known for use in injection systems of internal combustion engines.

Furthermore, the fuel accumulator 16 is hydraulically coupled via lines to an injector 18 or a plurality of injectors 18. Each of the injectors 18 is assigned a combustion chamber of the internal combustion engine and each injector 18 can be actuated in such a way that fuel is injected into the combustion chamber. The fuel which is to be injected into combustion chambers of the internal combustion engine by means of the injectors 18 can reach a relatively high injection pressure by way of the high pressure pump 14. Excess fuel can be returned from the injectors 18 via an injector return line 46 back to the fuel tank 10.

A volumetric flow control valve 22, by way of which the fuel flow can be set from the prefeed pump 12 into the high pressure pump 14, is arranged between the prefeed pump 12 and the high pressure pump 14. A temperature sensor 24 is arranged between the prefeed pump 12 and the volumetric flow control valve 22. By means of the temperature sensor 24 and a pressure sensor 26, by way of which a fuel pressure p in the fuel accumulator 16 can be determined, and optionally as a function of further input variables, the volumetric flow control valve can be actuated in such a way that low pressure-side control of the fuel flow which is fed to the high pressure pump 14 is possible.

The fuel accumulator 16 is connected by means of an accumulator return line 42 to a pressure regulating valve 28 which can be actuated, for example, as a function of the fuel pressure p which is determined by the pressure sensor 26 in the fuel accumulator 16. If a predefined fuel pressure is exceeded in the fuel accumulator 16, the pressure regulating valve 28 can open and a part of the fuel which is conveyed by the high pressure pump 14 can be returned via the accumulator return line 42 back into the fuel tank 10.

A flushing line 29 which opens on the outlet side into the housing of the high pressure pump 14 branches off downstream of the prefeed pump 12, with the result that it is possible to flush the housing of the high pressure pump 14 with fuel during operation. Cooling and lubrication of the high pressure pump 14 can therefore be brought about. The fuel which is used for flushing purposes can subsequently be returned from the housing of the high pressure pump 14 via a flushing return line 36 back into the fuel tank 10.

In order to protect against particles which are entrained in the fuel flow or in order to separate water, a filter 38 is arranged upstream of the prefeed pump 12. The temperature sensor 24, by way of which a temperature can be determined which is representative of the filter 38, is arranged in the filter 38 or in its surroundings.

The flushing return line 36, the accumulator return line 42 and the injector return line 46 are preferably routed back to the fuel tank 10.

The injection system for an internal combustion engine comprises a control unit 50. The control unit 50 has sensors which can detect different measured variables and in each case can determine the value of the measured variables. As a function of at least one of the measured variables, the control unit 50 determines actuating variables which can then be converted into one or more actuating signals for controlling the actuators by means of corresponding actuating drives. The actuators are, for example, the prefeed pump 12 and the volumetric flow control valve 22, and sensors are, for example, the temperature sensor 24 and the pressure sensor 26. The control unit 50 can also be called a device for operating the injection system for an internal combustion engine.

In the following text, the function of the injection system is to be described briefly:

The prefeed pump 12 conveys fuel out of the fuel tank 10. The fuel then passes via the temperature sensor 24 and the filter 38 to the volumetric flow control valve 22. As much fuel as is required by the fuel accumulator 16 is made available to the high pressure pump 14 by the volumetric flow control valve 22. The fuel is delivered by means of the high pressure pump 14 via the fuel accumulator feed line 44 to the fuel accumulator 16. From the fuel accumulator 16, the fuel is fed to the injectors 18, and is injected by the latter into the combustion chambers of the internal combustion engine.

The fuel pressure p which is required in the fuel accumulator is set by the pressure regulating valve 28 in the accumulator return line 42. If the fuel pressure p rises too much in the fuel accumulator 16 or if the fuel pressure p in the fuel accumulator 16 is to be reduced in a targeted manner, fuel can be released from the fuel accumulator 16 by means of the pressure regulating valve 28 via the accumulator return line 42.

Figure 2:
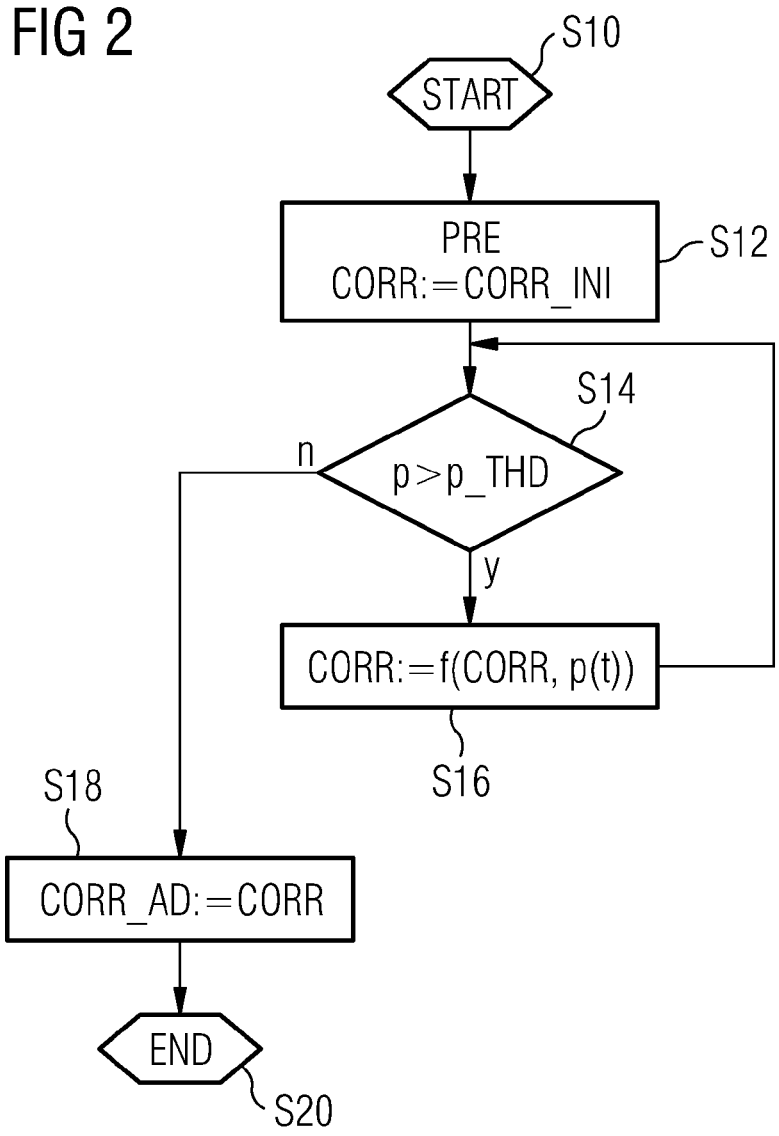
FIG. 2 shows a flow chart of a program for controlling the injection system of the internal combustion engine.
Figure 3:
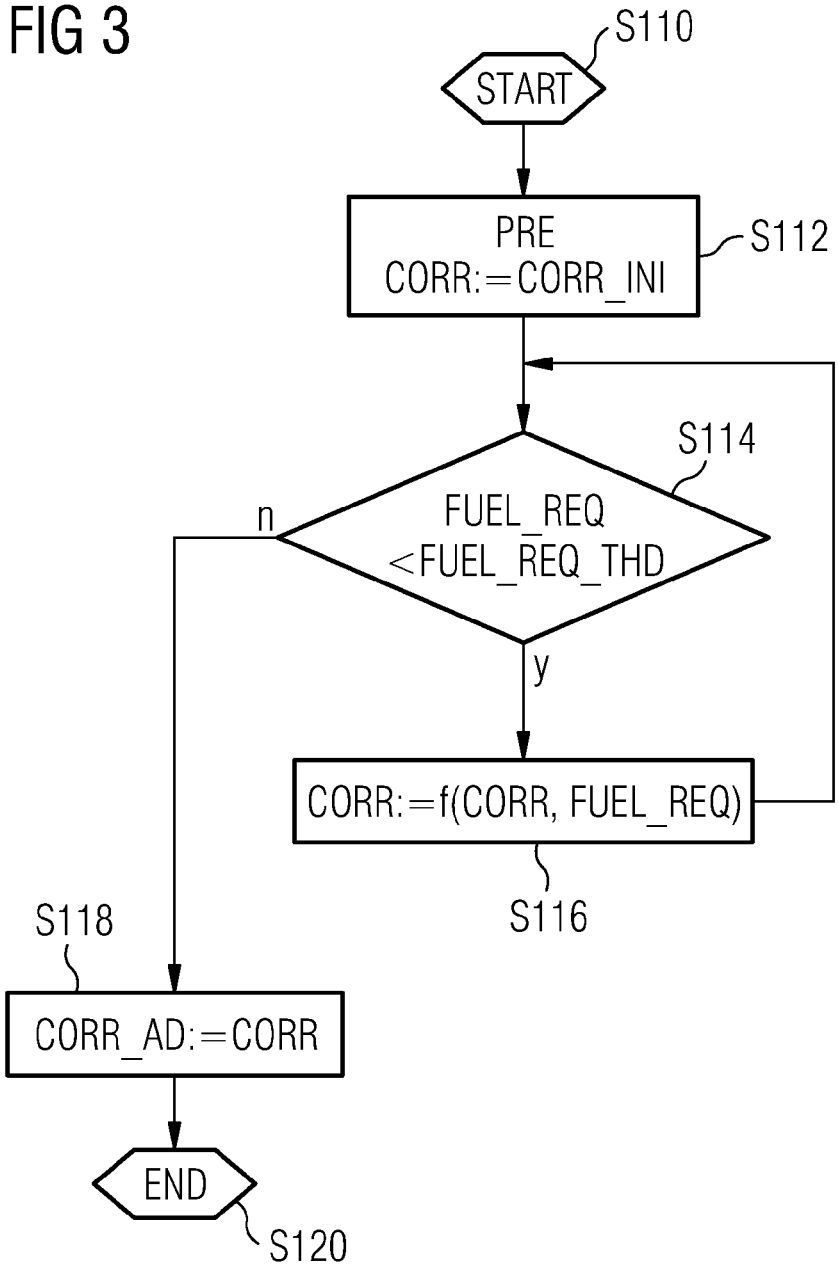
FIG. 3 shows a further flow chart of a program for controlling the injection system of the internal combustion engine.

FIGS. 2 and 3 diagrammatically show programs for controlling the device for operating the injection system of the internal combustion engine, which programs are preferably stored on a storage medium of the control unit 50. The programs serve to adapt a correction value CORR for the prefeed pump 12 in such a way that the fuel flow into the fuel accumulator 16 is so high that it is just sufficient for the fuel to be available in the fuel accumulator 16 at a sufficient pressure for the injectors 18 for injection into the internal combustion engine.

The program shown in FIG. 2 is preferably started in a step S10, in which optionally variables are initialized. This preferably takes place during start up of the internal combustion engine. In a step S12, a prefeed value PRE which is a function of at least one operating variable of the internal combustion engine is determined from a pilot control characteristic diagram, and the correction value CORR is initialized with a safety value CORR_INI. The prefeed value PRE is stored in a pilot control characteristic diagram of the control unit 50, and the safety value CORR_INI represents a safety variable for the prefeed pump 12. It is configured in such a way that deviations from a predefined conveying behavior of the prefeed pump 12 which lie within a certain predefined tolerance region are compensated for, with the result that a sufficient delivery performance of the prefeed pump 12 is still ensured. The safety value CORR_INI takes, for example, the statistical spread of different prefeed pumps into consideration, in particular dynamics during operation of the injection system or voltage fluctuations.

In a step S14, a check is carried out as to whether the fuel pressure p which is representative of the fuel accumulator 16 for the current correction value CORR is greater than a predefined threshold value p_THD of the fuel pressure which is representative of the fuel accumulator 16. If the condition of step S12 is met, the processing is continued in step S16. If the condition of step S14 is not met, that is to say the fuel pressure p which is representative of the fuel accumulator 16 experiences a collapse, with the result that the fuel pressure p which is representative of the fuel accumulator 16 is at least intermittently lower than the predefined threshold value p_THD of the fuel pressure which is representative of the fuel accumulator 16, then the processing is continued in a step S18.

In a step S16, the correction value CORR is varied as a function of the correction value CORR and of the fuel pressure p in such a way that the delivery performance of the prefeed pump 12 is reduced. Subsequently, the processing is continued in step S14.

In step S18, an adapted correction value CORR_AD is fixed by the current correction value CORR being assigned to it. In the case of the adapted correction value CORR_AD, the fuel flow into the fuel accumulator 16 is so high that it is just sufficient for the fuel to be available in the fuel accumulator 16 at sufficient pressure for the injectors 18 for injection into the internal combustion engine. The processing of the program is subsequently continued in step S20.

In step S20, the program is ended. The program is preferably executed regularly once during an operating run of the internal combustion engine.

The program which is shown in FIG. 3 is preferably started in a step S110, in which optionally variables are initialized. This preferably takes place during start up of the internal combustion engine.

In a step S112, the prefeed value PRE which is a function of at least one operating variable of the internal combustion engine is determined from the pilot control characteristic diagram, and the correction value CORR is initialized with the safety value CORR_INI.

In a step S114, a check is carried out as to whether a value FUEL_REQ of the actuating variable of the volumetric flow control valve 22 for the current correction value CORR is lower than a predefined threshold value FUEL_REQ_THD of the actuating variable of the volumetric flow control valve 22. If the condition of step S112 is met, the processing is continued in step S16. If the condition of step S114 is not met, that is to say the value FUEL_REQ of the actuating variable of the volumetric flow control valve 22 is at least intermittently greater than the predefined threshold value FUEL_REQ_THD of the actuating variable of the volumetric flow control valve 22, then the processing is continued in a step S118.

In a step S116, the correction value CORR is varied as a function of the correction value CORR and of the fuel pressure p in such a way that the delivery performance of the prefeed pump 12 is reduced. Subsequently, the processing is continued in step S114.

In step S118, the adapted correction value CORR_AD is fixed by the current correction value CORR being assigned to it. The processing of the program is subsequently continued in step S120.

In step S120, the program is ended. The program is preferably executed regularly once during an operating run of the internal combustion engine.

The adaptation of the correction value CORR in order to achieve the adapted correction value CORR_AD preferably takes place during a full load mode, an overrun mode or an idling mode of the internal combustion engine.

As a result of the determination of the adapted correction value CORR_AD, it is possible to keep the safety margin for the prefeed pump 12 as small as possible, in the process to make safe operation of the injection system possible and nevertheless to achieve an energetic optimization for the prefeed pump 12.

What is claimed is:

1. A method for operating an injection system for an internal combustion engine having a prefeed pump for conveying fuel out of a fuel tank and having a high pressure pump which is arranged downstream of the prefeed pump for conveying the fuel into a fuel accumulator, the method comprising:

determining a prefeed value which is a function of at least one operating variable of the internal combustion engine as a function of a pilot control characteristic diagram, initializing a correction value for the prefeed pump with a safety value which is predefined in such a way that deviations from a predefined conveying behavior of the prefeed pump which lie within a predefined tolerance range are compensated for in such a way that a sufficient delivery performance of the prefeed pump is ensured, actuating the prefeed pump as a function of the prefeed value and the correction value, and adapting the correction value with regard to its effect to the conveying behavior of the prefeed pump as a function of a variable of the injection system, the value or value profile of which variable is representative for whether a desired pressure can be reached in the fuel accumulator, to be precise in the context of a reduction in the delivery performance of the prefeed pump as long as the value is representative for the fact that the desired pressure is reached in the fuel accumulator;

the variable of the injection system, the value or value profile of which variable is representative for whether a desired pressure can be reached in the fuel accumulator, being a determined time-dependent profile of the pressure in the fuel accumulator, and the value being representative in this period for the fact that predefined deviations are not exceeded by a setpoint value of the pressure.

2. The method for operating an injection system for an internal combustion engine according to claim 1, the injection system having a volumetric flow control valve which is arranged hydraulically between the prefeed pump and the high pressure pump and by way of which the fuel flow from the prefeed pump into the high pressure pump can be set, the variable of the injection system, the value or value profile of which variable is representative for whether a desired pressure can be reached in the fuel accumulator, being a time-dependent profile of a value of an actuating variable of the volumetric flow control valve, which value is representative for the requirement of fuel for the high pressure pump, and the value being representative in this period for the fact that a predefined value range of the actuating variable of the volumetric flow control valve is not departed from.

3. The method according to claim 1, wherein the correction value is adapted with regard to its effect to the conveying behavior of the prefeed pump during an idling mode of the internal combustion engine.

4. The method according to claim 1, wherein the correction value is adapted with regard to its effect to the conveying behavior of the prefeed pump during a full load mode of the internal combustion engine.

5. A device for operating an injection system for an internal combustion engine having a prefeed pump for conveying fuel out of a fuel tank and having a high pressure pump which is arranged downstream of the prefeed pump for conveying the fuel into a fuel accumulator, the device being configured to:

determine, as a function of a pilot control characteristic diagram, a prefeed value which is a function of at least one operating variable of the internal combustion engine, initialize a correction value for the prefeed pump with a safety value which is predefined in such a way that deviations from a predefined conveying behavior of the prefeed pump which lie within a predefined tolerance range are compensated for in such a way that a sufficient delivery performance of the prefeed pump is ensured, actuate the prefeed pump as a function of the prefeed value and the correction value, and adapt the correction value with regard to its effect to the conveying behavior of the prefeed pump as a function of a variable of the injection system, the value or value profile of which variable is representative for whether a desired pressure can be achieved in the fuel accumulator, to be precise in the context of a reduction in the delivery performance of the prefeed pump as long as the value is representative for the fact that the desired pressure can be reached in the fuel accumulator;

wherein the variable of the injection system, the value or value profile of which variable is representative for whether a desired pressure can be reached in the fuel accumulator, is a determined time-dependent profile of the pressure in the fuel accumulator, and the value is representative in this period for the fact that predefined deviations are not exceeded by a setpoint value of the pressure.

6. The device according to claim 5, wherein the injection system comprises a volumetric flow control valve which is arranged hydraulically between the prefeed pump and the high pressure pump and by way of which the fuel flow from the prefeed pump into the high pressure pump can be set, and wherein the variable of the injection system, the value or value profile of which variable is representative for whether a desired pressure can be reached in the fuel accumulator, is a time-dependent profile of a value of an actuating variable of the volumetric flow control valve, which value is representative for the requirement of fuel for the high pressure pump, and the value is representative in this period for the fact that a predefined value range of the actuating variable of the volumetric flow control valve is not departed from.

7. The device according to claim 5, wherein the correction value is adapted with regard to its effect to the conveying behavior of the prefeed pump during an idling mode of the internal combustion engine.

8. The device according to claim 5, wherein the correction value is adapted with regard to its effect to the conveying behavior of the prefeed pump during a full load mode of the internal combustion engine.

9. An injection system for an internal combustion engine comprising a prefeed pump for conveying fuel out of a fuel tank, a high pressure pump which is arranged downstream of the prefeed pump for conveying the fuel into a fuel accumulator, and a control device being operable to determine, as a function of a pilot control characteristic diagram, a prefeed value which is a function of at least one operating variable of the internal combustion engine, to initialize a correction value for the prefeed pump with a safety value which is predefined in such a way that deviations from a predefined conveying behavior of the prefeed pump which lie within a predefined tolerance range are compensated for in such a way that a sufficient delivery performance of the prefeed pump is ensured, to actuate the prefeed pump as a function of the prefeed value and the correction value, and adapt the correction value with regard to its effect to the conveying behavior of the prefeed pump as a function of a variable of the injection system, the value or value profile of which variable is representative for whether a desired pressure can be achieved in the fuel accumulator, to be precise in the context of a reduction in the delivery performance of the prefeed pump as long as the value is representative for the fact that the desired pressure can be reached in the fuel accumulator;

wherein the variable of the injection system, the value or value profile of which variable is representative for whether a desired pressure can be reached in the fuel accumulator, is a determined time-dependent profile of the pressure in the fuel accumulator, and the value is representative in this period for the fact that predefined deviations are not exceeded by a setpoint value of the pressure.

10. The system according to claim 9, wherein the injection system comprises a volumetric flow control valve which is arranged hydraulically between the prefeed pump and the high pressure pump and by way of which the fuel flow from the prefeed pump into the high pressure pump can be set, and wherein the variable of the injection system, the value or value profile of which variable is representative for whether a desired pressure can be reached in the fuel accumulator, is a time-dependent profile of a value of an actuating variable of the volumetric flow control valve, which value is representative for the requirement of fuel for the high pressure pump, and the value is representative in this period for the fact that a predefined value range of the actuating variable of the volumetric flow control valve is not departed from.

11. The system according to claim 10, further comprising a temperature sensor arranged between the prefeed pump and the volumetric flow control valve by way of which a fuel pressure p in the fuel accumulator can be determined.

12. The system according to claim 11, further comprising a filter arranged upstream of the prefeed pump, wherein the temperature sensor is arranged in the filter or in its surroundings.

13. The system according to claim 9, wherein the correction value is adapted with regard to its effect to the conveying behavior of the prefeed pump during an idling mode of the internal combustion engine.

14. The system according to claim 9, wherein the correction value is adapted with regard to its effect to the conveying behavior of the prefeed pump during a full load mode of the internal combustion engine.

15. The system according to claim 9, wherein the prefeed pump is a vane cell pump.

16. The system according to claim 9, wherein the prefeed pump is arranged inside the fuel tank.

17. The system according to claim 9, the high pressure pump is configured as a radial piston pump or as an in-line piston pump having a plurality of cylinder units.

* * * * *